US007647968B2

(12) United States Patent
Corbett et al.

(10) Patent No.: US 7,647,968 B2
(45) Date of Patent: Jan. 19, 2010

(54) SCREEN SAVER SUB

(75) Inventors: Thomas G. Corbett, Willis, TX (US); Christian F. Bayne, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 241 days.

(21) Appl. No.: 11/746,991

(22) Filed: May 10, 2007

(65) Prior Publication Data

US 2008/0277114 A1 Nov. 13, 2008

(51) Int. Cl.
*E21B 43/04* (2006.01)

(52) U.S. Cl. ..... 166/278; 166/51; 166/227

(58) Field of Classification Search ..... 166/51, 166/227, 232, 278
See application file for complete search history.

(56) References Cited

U.S. PATENT DOCUMENTS 2,837,032 A * 6/1958 Horsting, Sr. ..... 92/78
3,987,854 A * 10/1976 Callihan et al. ..... 166/278
4,372,384 A * 2/1983 Kinney ..... 166/278
4,570,714 A * 2/1986 Turner et al. ..... 166/278
5,676,208 A 10/1997 Finley
6,318,465 B1 11/2001 Coon et al.
6,619,397 B2 9/2003 Coon et al.
2002/0096329 A1 * 7/2002 Coon et al. ..... 166/278
2008/0105437 A1 * 5/2008 Hill et al. ..... 166/370

OTHER PUBLICATIONS

E. Paul Bercegeay, et al., "A One-Trip Gravel Packing System", SPE 4771; Feb. 1974; 12 pages.
Stephen P. Mathis; Sand Management: A Review of Approaches and Concerns; SPE 82240; May 2003; 7 pages.

* cited by examiner

*Primary Examiner*—Hoang Dang
(74) *Attorney, Agent, or Firm*—Steve Rosenblatt

(57) ABSTRACT

A transition piece is provided near an end of a screen assembly to allow transition from a lighter weight and collapse resistant pipe under the screen sections to a heavier wall and higher collapse strength pipe between the top of the screen and the isolation packer. When a screen out occurs, the heavier wall pipe can handle the new pressures that are applied to the formation and to the tubular to try to collapse it. The screen portion can still be built with thinner wall pipe as the screen out condition protects that pipe from collapse pressure because the fully gravel packed annular space keeps the surface applied pump pressure from exerting a collapse force on the base pipe under the screen.

22 Claims, 1 Drawing Sheet

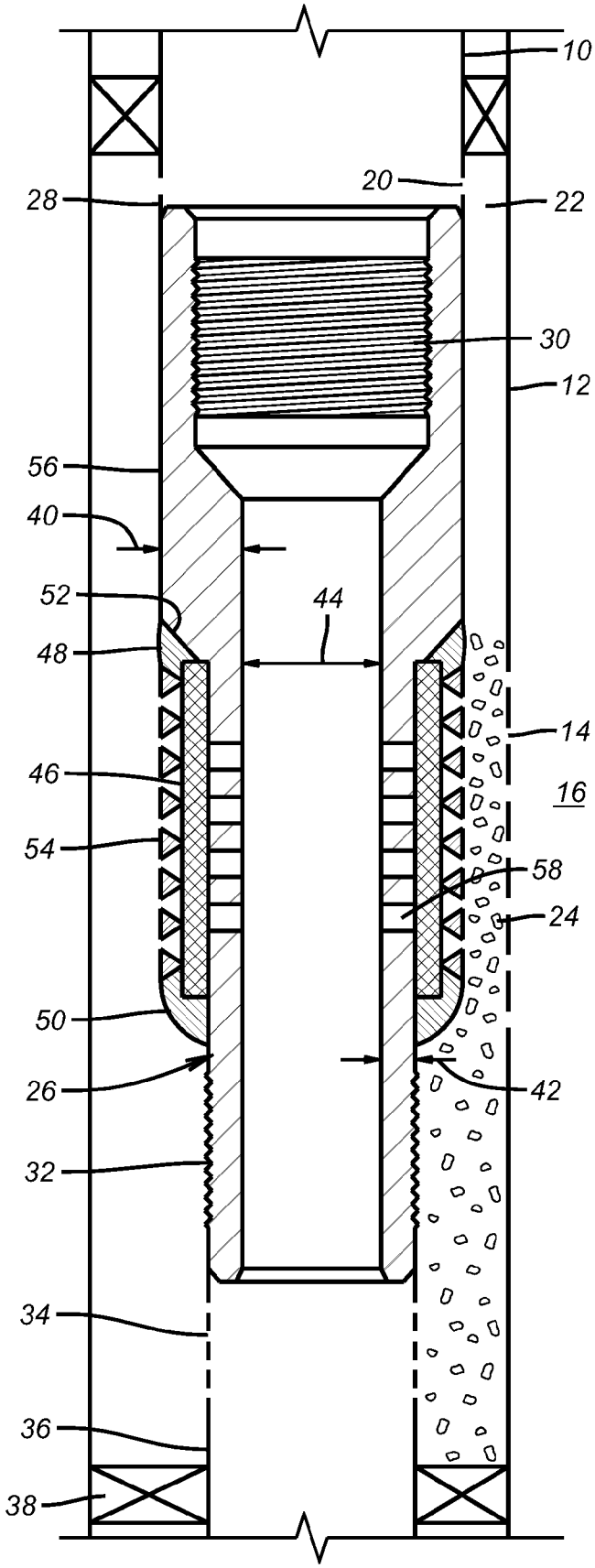
10
20
28
22
30
12
56
40
52
44
48
14
46
16
54
58
24
50
26
42
32
34
36
38

SCREEN SAVER SUB

FIELD OF THE INVENTION

The field of the invention is downhole completions and more particularly completions involving fracturing and gravel packing with the screen in the well.

BACKGROUND OF THE INVENTION

Completions can involve insertion of section of screen in an isolated zone that is sealed off with packers. The screen assembly is sealed into the lower packer and generally has a section of blank pipe above the screen portion connected to the bottom of the upper packer at either end of the zone that is isolated for subsequent production. When the completion plan calls for fracturing and gravel packing the procedure is to deliver the proppant in viscous slurry through the top packer. From there the slurry goes through a crossover to get into the annular space around the screen. As long as some portion of the screen is uncovered the pressure of the viscous carrier fluid can be communicated to the formation in a fairly predictable manner. Once the annular space fills high enough with proppant to cover the screens, the pressure can rise rapidly. This is because the annularly shaped pile of proppant in viscous fluid acts similar to a cohesive solid. At this point applied pressure reaches the annular space above the screen portion and below the packer. This condition is known as a screen out.

When a screen out happens, high pressures are applied to the tubular that is above the screen portion and below the packer. There is a risk that the pressures generated while fracturing the formation at that point could be higher than the collapse strength of the tubular. One solution to this problem used in the past is to build the screen assembly out of heavier wall and/or higher material strength pipe including the base pipe portion that is under the screen. The problem with that approach is that it is expensive and when the well space is limited, the provision of thick wall pipe simply results in a decrease in the available inside diameter. That inside diameter constriction could impede the passage of tools through the screen for a subsequent operation and production from the well.

The present invention addresses this problem by allowing thicker wall blank pipe to be used adjacent to the packer and above the screen portion of the completion in conjunction with a lower rated tubular under the screen. To do this a transition piece is used at the top of the screen assembly that can be threaded into the thinner wall and/or smaller diameter and/or lower material strength pipe that underlies the screens and a larger diameter and/or thicker wall and/or higher material strength portion above the screen portion of the assembly. These and other aspects of the present invention will become more readily apparent from a review of the description of the preferred embodiment and the associated drawing that appears below while understanding that the full scope of the invention is measured by the claims at the end of the application.

SUMMARY OF THE INVENTION

A transition piece is provided near an end of a screen assembly to allow transition from a low collapse resistant pipe under the screen sections to a higher collapse strength pipe between the top of the screen and below the isolation packer. When a screen out occurs, the heavier wall and/or higher material strength pipe can handle the higher pressures that are applied to the annular space and to the tubular trying to collapse it. The screen portion can still be built with thinner wall and/or lower strength pipe as the screen out condition protects that pipe from collapse pressure because the fully gravel packed annular space keeps the surface applied pump pressure from exerting a collapse force on the base pipe under the screen. The internal diameter under the screen does not have to be reduced because the heavy wall pipe is not provided there. Above the screen, a heavy wall pipe can be provided because the absence of the screen layer allows more room for a larger pipe with thicker wall without decrease in internal diameter as compared to under the screen. An opening or openings in the adapter prevent collapse pressure from affecting the blank pipe above the screen. The opening or openings can be covered with a screen or shaped to hold the proppant back.

BRIEF DESCRIPTION OF THE DRAWING

FIG. 1 is a section view showing the transition component with a heavy wall above the screen and a thinner wall under the screen.

DETAILED DESCRIPTION OF THE PREFERRED EMBODIMENT

FIG. 1 shows a tubing string 10 that can extend from the surface into casing 12 for example or into open hole. Casing 12 can have slots or perforations 14 made by a gun, for example, for access to a formation 16. Tubing string 10 extends through a packer 18 and then goes to a crossover 20. Crossover 20 provides access to the annular space 22 for the gravel slurry 24. The sub 26 that is the present invention is mounted below some blank pipe 28 that extends from the crossover 20 (shown schematically).

Sub 26 has a top thread 30 for connection to blank pipe 28. It has a lower thread 32 for connection to one or more screen sections 34. Below screen sections 34 is an adapter 36 to allow connection to or sealing into lower packer 38. The wall thickness 40 in sub 26 is greater than the wall thickness 42 but without reduction in internal diameter 44.

A screen assembly 46 which can be any number of known screen designs can be attached in a variety of ways to sub 26 such as by welds 48 and 50. Because of transition surface 52 outer surface 54 of screen assembly 46 is flush or close to it with outer surface 56 where the wall thickness 40 is relatively large. Openings 58 allow flow through screen assembly 46. Alternatively, the openings can be sized to hold back the proppant while preventing application of collapse pressure after a screen out to the blank pipe that exists above the top-most screen, for example, that is made of a fairly thin wall and would otherwise be subjected to a collapse force. In that version, a separate screen 46 would not be necessary.

A screen out condition occurs when the slurry 24 fills the annular space 22 to above the screen assembly 46. Using sub 26, a greater collapse resistance is provided where it is needed above screen assembly 46 by thicker wall 40 as compared to under screen assembly 46 where the wall thickness is significantly less at 42 because a greater collapse resistance is not required at that location because the full annulus 22 with slurry 24 prevents the collapse force from reaching the thinner wall portion 42. On the other hand, merely providing a thicker wall thickness at 40 where needed for additional collapse resistance comes at the cost of smaller through diameter 44. This is because the wall is made thicker above the screen 46 where there is room to simply increase the outer and the inner diameter and keep the inner diameter at least as large as the inner diameter under the screen 46 and other screens 34 that can be mounted below.

The internal diameter 44 is not reduced at thick wall section 40 and whatever length of screen 34 and 46 are used can have thinner wall pipe and/or lower material strength to reduce weight and cost and to avoid providing pipe that can withstand a greater collapse force where it is not needed due to the dynamics of a screen out. The adapter can be made of a stronger material than the base pipe as a way to attain the greater collapse strength between its opening and its end closer to the packer above.

The above description is illustrative of the preferred embodiment and many modifications may be made by those skilled in the art without departing from the invention whose scope is to be determined from the literal and equivalent scope of the claims below.

We claim:

1. A completion assembly for a production zone downhole defined by at least one packer, comprising:

a screen assembly having an uphole end and defining a surrounding annulus and further comprising a base pipe having a first internal diameter and a first wall thickness, said base pipe having openings covered by a screen and a blank pipe segment extending beyond said screen;

a sub securable to said blank pipe segment at said uphole end of said screen assembly having at least one opening covered by a sub screen to prevent collapse of said blank pipe segment on said screen assembly said sub having a greater collapse strength on a first end between said opening and the packer than said blank pipe segment on said screen assembly and said sub screen extending into contact with said first end portion having a greater collapse strength.

2. The assembly of claim 1, wherein:

said sub comprises a second wall thickness greater than said first wall thickness;

said sub having a second internal diameter at least as large as said first internal diameter.

3. The assembly of claim 2, wherein:

said sub has a third wall thickness that differs from said second wall thickness.

4. The assembly of claim 3, wherein:

said third wall thickness is substantially the same as said first wall thickness.

5. The assembly of claim 2, wherein:

said sub further comprises a screen.

6. The assembly of claim 5, wherein:

said sub has a third wall thickness that differs from said second wall thickness;

said screen disposed on said third wall thickness.

7. The assembly of claim 6, wherein:

said second wall thickness has an outer dimension that extends radially at least as far as said screen on said sub.

8. The assembly of claim 7, wherein:

said screen on said sub is attached mechanically or by welding.

9. The assembly of claim 6, wherein:

said second and third wall thicknesses are separated by a transition surface.

10. The assembly of claim 6, wherein:

said sub having a second internal diameter at least as large as said first internal diameter.

11. The assembly of claim 2, wherein:

said sub has threaded end connections of different sizes.

12. The assembly of claim 6, wherein:

said sub has threaded end connections of different sizes.

13. The assembly of claim 12, further comprising:

blank pipe connected to the larger of said threaded end connections and having a thickness at least as great as said second wall thickness.

14. The assembly of claim 1, wherein:

said opening is shaped to act as a screen for at least some solids in the annulus.

15. A method of well completion, comprising:

running in a screen assembly having an uphole end into an isolated zone, said screen assembly having a a base pipe with a blank pipe portion that extends to an end beyond a perforated section that sits under a screen, said blank pipe portion having a first strength to resist collapse;

providing a sub connected to said blank pipe portion above said uphole end of said screen assembly and having at least one opening covered by a sub screen with a greater resistance to collapse between said opening and a first end not connected to said blank pipe portion than said first strength on said blank pipe portion and said sub screen extending into contact with said first end portion having a greater collapse strength.

16. The method of claim 15, comprising:

providing an internal diameter in said sub at least as great as an internal diameter of said screen assembly.

17. The method of claim 16, comprising:

providing two different wall thicknesses on said sub.

18. The method of claim 17, comprising:

providing two different outer diameters on said sub.

19. The method of claim 18, comprising:

providing a screen and wall openings on the smaller thickness of said sub.

20. The method of claim 19, comprising:

making the outer diameter of the screen no larger than the larger diameter on said sub.

21. The method of claim 20, comprising:

welding or mechanically attaching said screen to said sub.

22. The method of claim 15, comprising:

shaping said opening to act as a screen for at least some solids in the annulus.

* * * * *